United States Patent [19]

Gherardi

[11] Patent Number: 4,766,991

[45] Date of Patent: Aug. 30, 1988

[54] DEVICE FOR FEEDING ROD-LIKE ARTICLES, PARTICULARLY FILTER PLUGS FOR FILTER-TIPPED CIGARETTES

[75] Inventor: Gian L. Gherardi, Medicina, Italy

[73] Assignee: SASIB S.p.A., Bologna, Italy

[21] Appl. No.: 938,717

[22] Filed: Dec. 5, 1986

[30] Foreign Application Priority Data

Dec. 13, 1985 [IT] Italy ..... 12623 A/85

[51] Int. Cl.[4] ..... B65G 47/12; B65G 47/26

[52] U.S. Cl. ..... 198/455; 198/347; 198/550.2; 221/168; 131/282

[58] Field of Search ..... 198/455, 347; 221/162, 221/168; 131/94, 282, 283, 909, 550.2

[56] References Cited

U.S. PATENT DOCUMENTS

| | | | |
|---|---|---|---|
| 3,485,208 | 12/1969 | Hemming et al. | 131/282 |
| 3,715,056 | 2/1973 | Preston | 198/455 |
| 4,020,973 | 2/1977 | Hinz | 221/13 |
| 4,368,742 | 1/1983 | Wahle et al. | 131/909 |

FOREIGN PATENT DOCUMENTS

| | | | |
|---|---|---|---|
| 363283 | 8/1962 | Switzerland | 131/94 |

*Primary Examiner*—Robert J. Spar
*Assistant Examiner*—Jennifer L. Doyle
*Attorney, Agent, or Firm*—Spencer & Frank

[57] ABSTRACT

A feeding device for withdrawing from a feeding hopper (1) rod-like articles, particularly filter plugs in the manufacture of filter-tipped cigarettes, and for singling these articles. The device comprises a rotary fluted drum (2) forming at least part of the bottom of hopper (1), and a repelling roller (13) that is arranged between the wall (9) of the hopper (1) and the drum (2), in the vicinity of the end from which the drum comes out of the hopper, and that is rotated in a controlled manner in the same direction as the drum. The repelling roller (13) is so mounted that its axis is movable substantially parallel to the peripheral surface of drum (2) and, more particularly, it is carried by a lever (10) that is swingable about a shaft (4) which is concentric or close to the shaft (6) for the rotation of the drum. The repelling roller (13) is urged by a return device (14) toward a normal operative position in which it pushes back the rod-like articles not contained within the flutes (102) in drum (2), and prevents these articles from getting out of the hopper (1) or from becoming wedged between the wall (9) of the hopper and the drum (2). The abnormal, deformed, or aggregated rod-like articles which are engaged in one flute (102) in drum (2), and protrude therefrom to a greater degree than the normal one, push the repelling roller (13) toward a displaced position in which a sensor is actuated and determines the stopping of drum (2) and/or of the machine associated with the feeding device. The travel of the repelling roller (13) from its normal operative position to its displaced position is a relatively long travel, so that the roller is given the possibility of pushing back the abnormal article or articles or of loosening their clusters, before promoting the stopping of the drum or of the machine.

8 Claims, 3 Drawing Sheets

DEVICE FOR FEEDING ROD-LIKE ARTICLES, PARTICULARLY FILTER PLUGS FOR FILTER-TIPPED CIGARETTES

SUMMARY OF THE INVENTION

The object of the invention is a feeding device for withdrawing rod-like articles from a feeding hopper and for singling same, and comprising a rotary fluted drum that preferably is a suction drum, and that forms at least part of the hopper bottom, and a so-called repelling roller that is arranged between the hopper wall and the drum, in correspondence of the end from which said drum comes out of the hopper, and is rotated in a controlled manner in the same direction as the drum so as to push back the rod-like articles not contained in the drum flutes, and as to prevent them from getting out of the hopper or from becoming wedged between the hopper wall and the drum, the repelling roller being supported in a compliant manner and being urged by a return force toward a normal operative position from which by one or more abnormal rod-like articles engaged in one flute and excessively protruding therefrom, it may be driven into a displaced position in which sensor means are actuated and stop the drum and/or at least a part of the machine with which the feeding device is associated.

More particularly, the invention relates to a device of the above-described type for feeding the filter plugs used in the production of filter-tipped cigarettes.

In this instance, when the hopper of the above-disclosed device is fed with filter plugs coming directly from the filer plug-making machine, these filter plugs may present traces of not fully dried glue, which may cause one or more filter plugs to stick on a filter plug regularly contained in a drum flute. In this instance, and when the shaft for the rotation of the repelling roller is mounted in a fixed position, the abnormal group of two or more superposed and stuck together filter plugs associated with a drum flute, undesirably wedges itself between the rotary fluted drum and the repelling roller. Such an inconvenience may occur also owing to one or more ovalized, or anyhow deformed filter plugs being engaged in one flute. The forced passage of a group of filter plugs under the repelling roller with a stationary shaft for its rotation produces the crushing and the breaking of these plugs which may then disperse their components, may deform the shaft for the rotation of the repelling roller, may damage other members and be the cause of other troubles, thus impairing the regular operation of the machine, and reducing its output.

In order to obviate to these drawbacks, it was already proposed to support the repelling roller in a compliant manner substantially perpendicularly to the peripheral surface of the drum, and particularly to mount the said roller onto a roller-carrying lever which is allowed to swing about a fixed shaft arranged eccentrically to the drum, generally out of the peripheral outline thereof. A return spring acts upon the roller-carrying lever so as to urge the repelling roller toward the drum and as to cause it to take a normal operative position, in which the said roller performs its normal functions. When one or more filter plugs become superposed to, and stick on a filter plug contained in one drum flute, such an abnormal filter plug group passes under the repelling roller and elastically lifts the same from the flute drum and correspondlingly displaces angularly the roller-carrying lever, which actuates a microswitch. This promotes the disengagement of an electromagnetic coupling which is inserted in the drive for operating the fluted drum or at least some parts of the machine applying the filter plugs to the cigarettes, or this machine as a whole, so that the said parts of the entire machine will be stopped.

The elastically compliant support for the repelling roller and the connection of said roller with a device for at least partly stopping the cigarette filter plug-applying machine thus eliminate any damages that may be produced by the wedging of a group of two or more filter plugs under a stationary repelling roller, but they bring about the total or partial stopping of the cigarette filter plug-applying machine.

Such a stopping is continued for a certain period of time and brings about a relative loss of output, which is particularly important with the present high manufacturing rates, such as, for example, of 8,000 cigarettes per minute, and more than that. Furthermore, in the instance of the machine having been entirely stopped, when the operation is subsequently resumed it is impossible to feed the cigarettes to the filter plug-applying machine before a predetermined speed having been reached. Consequently, the cigarettes being produced during the corresponding time interval by the cigarette-making machine, must be discarded.

In the known feeding devices of the type as initially disclosed, the compliant repelling roller already promotes after a short upward travel from the drum, the partial or total stopping of the machine provided with such a feeding device, since the repelling roller is moved substantially perpendicularly to the peripheral surface of the drum, and must promote the stopping of the drum and/or of the machine before a deformed filter plug or a group of stuck together filter plugs, or the like, passing under the lifted up repelling roller. Therefore, the stopping of the machine using these known feeding devices practically occurs much frequently, which further increases the above stated drawbacks merely due to the drum and/or the machine being stopped.

The invention aims to eliminate these and other drawbacks of the known constructions and, more particularly, its object is to sensibly reduce the frequency at which the apparatus or the machines associated with a feeding device with a compliant repelling roller of the type as initially disclosed, are stopped.

This problem is solved by the invention in that the compliant repelling roller is movable substantially parallelly to the peripheral surface of the rotary fluted drum and is preferably mounted onto a roller-carrying lever which is swingable about a shaft being concentric or close to the shaft for the rotation of the drum.

Therefore, in the feeding device according to the invention it is possible to lengthen considerably the travel of the repelling roller from its normal operative position to its displaced position, in which the sensor means are actuated and promote the stopping of the drum, or the partial or the total stopping of the machine associated with the feeding device. During this longer travel of the repelling roller than it was hitherto possible with the known feeding devices, the repelling roller exerts a correspondingly protracted action on the rod-like article or articles engaged in one drum flute, which will cause the repelling roller to be entrained thereby and displaced, so that this roller often succeeds in pushing back the said abnormal article or articles into the mass of rod-like articles contained in the hopper, before the said repelling roller having reached its displaced position, in which the stopping is promoted of the drum and/or of the machine. In the particular instance of cigarette filter plugs, during the prolonged travel of the repelling roller from its normal operative position toward its displaced position, the repelling roller also has a sufficient time for frequently loosening, well before reaching its displaced position, a cluster of two or more superposed and stuck together filter plugs, which cluster, by being engaged in one flute of the rotary fluted drum and by protruding from said flute to a greater degree than the predetermined one, will cause the repelling roller to be entrained thereby and displaced from its normal operative position.

In both instances, the repelling roller does not promote the stopping of the drum or of the machine associated with the feeding device, and after having pushed back the abnormal rod-like article or articles engaged in one flute of the fluted drum, and/or after having loosened a cluster of two or more of these articles, by the action of the return force it is returned into its operative rest position.

According to a further feature of the invention, the speed of rotation of the repelling roller is automatically reduced during the travel of same from its normal operative position toward its displaced position, and it is increased during the reverse displacement of the repelling roller, and regains its predetermined value when the repelling roller has again reached its normal operative position. This feature of the invention is based on the acknowledgement that the action of the repelling roller for loosening the filter plug clusters is more efficient when this roller is rotated to a lower speed than the normal operative speed, which is just suitable for merely pushing back the filter plugs that are not accomodated within the drum flutes.

According to another feature of the invention, the displacement of the repelling roller from its normal operative position toward its displaced position causes a visible and/or audible warning signal to be generated, even or especially when the repelling roller does not reach its displaced position and by the action of the return force it is returned into its normal operative position, without promoting the stopping of the drum of the machine associated with the feeding device. By means of the signal an operator can find out and remove from the hopper - without stopping the machine - the abnormal rod-like article or articles pushes back by the repelling roller during the partial travel toward its displaced position.

BRIEF DESCRIPTION OF THE DRAWINGS

These and other features of the invention and the advantages arising therefrom will appear in the following specification of some preferred embodiments shown by way of non-limiting examples in the accompanying drawings, in which.

DESCRIPTION OF THE PREFERRED EMBODIMENT

Figure 1:
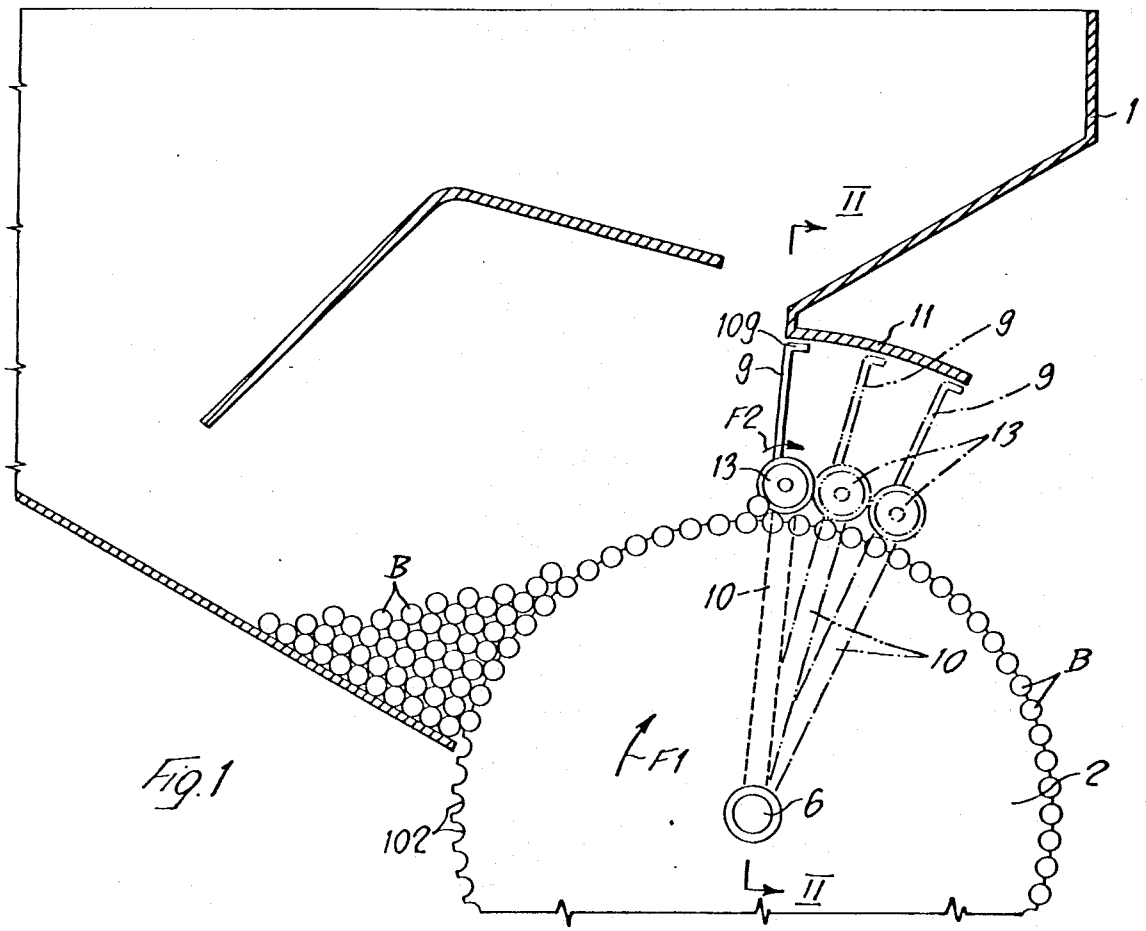
FIG. 1 is an elevational view with parts in section, showing a feeding device according to the invention.

Referring to the figures, numeral 1 denotes a hopper for feeding filter plugs B to a machine applying cigarette filter tips, to produce filter-tipped cigarettes. At least a part of the bottom of said hopper 1 is formed by a known drum 2 which is so driven as to be rotated in the direction of arrow F1, and is provided on its periphery with flutes 102 which can each contain only one filter plug B. More particularly, the drum 2 presents a cup shape and has its skirt encompassing an internal cylindrical body 3, which is secured to a stationary sleeve 4 extending in a cantilevered manner from the machine frame 5. The cup-shaped drum 2 has its bottom secured to a shaft 6 which is rotatably supported in a sleeve 4 and projects from this bottom on the side of its free end. The flutes 102 in drum 2 are provided with ports 7 through which a suction is applied at least in the vicinity of the opening of hopper 1 and for a certain length downstream thereof. For such a purpose, the ports 7 in flutes 102 come to coincide with a peripheral recess 8 in the central cylindrical body 3, and the said recess 8 extends for a certain fraction of the round angle and is suitably connected to a vacuum generator (not shown).

At least part of the wall 9 of hopper 1, situated at the end from which the drum 2 issues from the said hopper 1, is so constructed that it is movable parallelly to the peripheral surface of drum 2, and it is carried by a lever 10 which is mounted for a swinging motion about the stationary sleeve 4, co-axially to the said drum 2. More particularly, in the shown embodiment the said movable wall 9 of hopper 1 is substantially perpendicular to the peripheral surface of drum 2 and its upper end 109 is in, or almost in, sliding contact with the underside of a stationary bent-tile piece 11 extending outwardly of hopper 1, co-axially to the shaft 6 of drum 2.

In a bearing 12 provided at the upper end of the swingable lever 10 there is rotatably mounted the shaft 113 of a knurled repelling roller 13 extending in a cantilevered manner over the drum 2, between this roller and the movable wall 9 of hopper 1. A torsion return spring 14 inserted between the machine frame 5 and the boss 110 of the swingable lever 10, urges this lever toward the interior of hopper 1, in counter-clockwise direction in FIG. 1, so as to cause the same to abut against a stop 15, and keeps the movable wall 9 of hopper 1 and the underlying repelling roller 13 in a normal operative position, shown by solid lines in FIGS. 1 and 3. The repelling roller 3 is driven in rotation in the direction F2, i.e., in the same direction as drum 2, so that the adjacent facing surfaces of drum 2 and the repelling roller 13 are moved in opposite directions.

Figure 2:
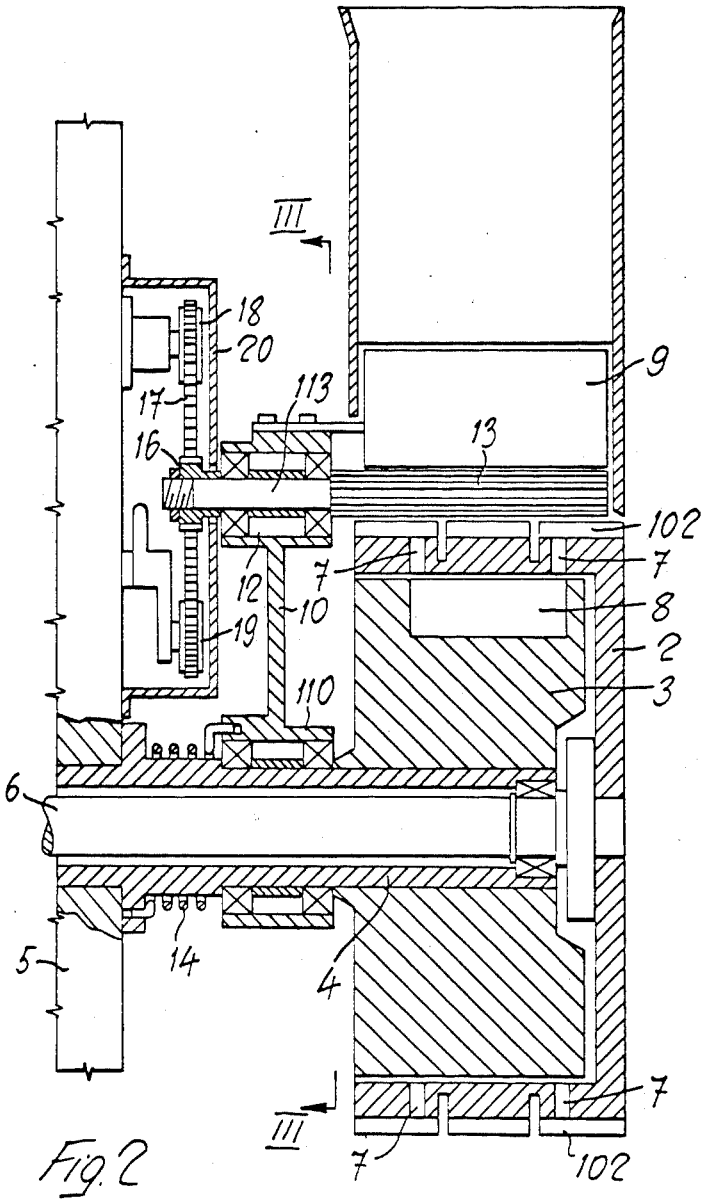
FIG. 2 is a sectional view in an enlarged scale, taken on line II—II of FIG. 1.
Figure 3:
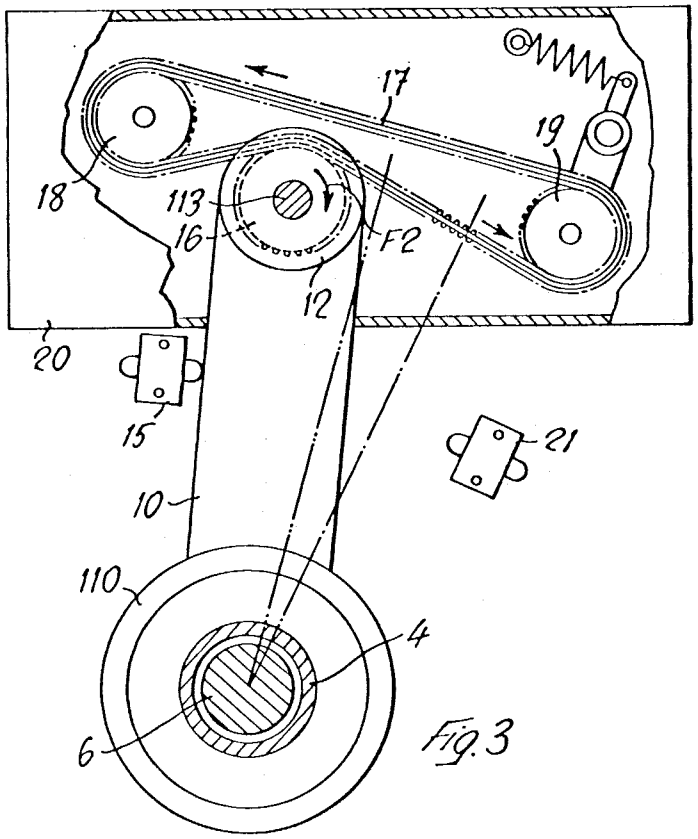
FIG. 3 is a sectional view on line III—III of FIG. 2, diagrammatically showing a first embodiment of the suitable means for changing the speed of rotation of the repelling roller during its travel.

In the embodiment according to FIGS. 2 and 3, the driving in rotation of the repelling roller 13 is effected by means of a pinion 16 which is secured to the end of a shaft 113 of the repelling roller 13, and is in mesh with the outer set of teeth in the lower branch of an endless belt 17 with a dual set of teeth, stretched between a driving gear wheel 18 and a tensioning gear wheel 19. The said belt 17 is arranged within a housing 20 fastened to the machine frame 5. The lower branch of belt 17 with which the pinion 16 of the repelling roller 13 is in mesh, extends substantially in the direction of movement of the repelling roller 13, for example, substantially tangentially to the drum 2, and runs in the direction that is concordant to the direction of rotation F1 of the said drum 2.

During the normal operation of the above described feeding device, the swingable lever 10 is stationary against the stop 15 and the repelling roller is in its respective normal operative position, in which it pushes back any filter plugs B not contained in the flutes 102 of drum 2, and prevents the same from getting out of hopper 1 or from wedging themselves between the wall 9 of hopper 1 and the drum 2.

However, it may occur that in one flute 102 of drum 2 there is engaged a group of two or more superposed and stuck together filter plugs B, of that in one flute 102 of drum 2 there is accomodated a deformed and, for example, ovalized filter plug B, such that it protrudes from the peripheral surface of drum 2 to a greater degree than the normal one. When such a cluster of filter plugs or such a deformed filter plug come to the repelling roller 13, they cause this roller to be entrained by the rotatory motion of drum 2, in the direction of arrows F1, and to be driven parallely to the peripheral surface of said drum 2, so that the swingable lever 10 and the associated movable wall 9 of hopper 1 are angularly moved to a corresponding degree about the stationary sleeve 4, against the counter load of the return spring 14. The said angular movement of the repelling roller 13 can occur over a relatively long distance, up to the swingable lever abutting against a further stop 21.

During the travel of the repelling roller 13, corresponding to the said angular movement of the swingable lever 10, the speed of rotation of the repelling roller 13 is automatically reduced since the pinion 16 for driving the repelling roller 13 is shifted concordantly with the direction in which runs the respective lower branch of the toothed belt 17. FIG. 1 shows by dash-and-dot-lines the end-of-travel position of the swingable lever 10, the repelling roller 13, and the movable wall 9 of hopper 1 against the limit stop 21, while dash-and-two-dots lines it shows an intermediate displaced position, between the said end-of-travel position and the normal operative position against the stop 15, shown by solid lines.

During a first relatively long part of the said travel of the repelling roller 13, this roller very frequently disengages from the respective flute 102 in drum 2 a cluster of filter plugs or a deformed filter plug that will cause it to be entrained and driven along with the drum 2, and pushes them back into the mass of filter plugs B contained in hopper 1. In the instance of clusters of two or more stuck together filter plugs B, the repelling roller 13 often also succeeds in promoting the loosening of said clusters. Such a loosening action of the repelling roller is made more efficient by the provision of reducing the rotational speed of said roller 13. When the repelling roller 13 succeeds in pushing back or loosening a cluster of filter plugs or in pushing back a deformed filter plug before reaching its end-of-travel position or a displaced position preceding the end-of-travel position, for example the intermediate displaced position shown, the driving thrust exerted on the repelling roller 13 ceases and this roller is returned to its normal operative position by the action of the counter load of the return spring 14, without stopping the drum 2 and/or the machine associated with the described feeding device. During such an angular return movement of the repelling roller 13 along with the swingable lever 10 and the movable wall 9 of hopper 1, the speed of rotation of the repelling roller 13 is increased up to its normal value, since the pinion 16 for driving the roller 13 is now shifted reversely to the direction in which runs the respective lower branch of the driving toothed belt 17. Whereas, when the repelling roller 13 does not succeed in loosening or pushing back a cluster of filter plugs, or in pushing back a deformed filter plug, and is further entrained thereby toward its end-of-travel position, in a second part of the travel of the repelling roller 13, for example between the intermediate displaced position shown by dash-and-two-dots lines, and the end-of-travel position, the swingable lever 10 and/or the movable wall 9 of hopper 1 will actuate a sensor, such as, for example, a microswitch (not shown) that promotes the stopping of the rotary fluted drum 2 and/or of the machine associated with the feeding device.

Thus, by using the feeding device according to the invention, the frequency of the stopping of the machine associated with the feeding device, is sensibly reduced. At the same time, the repelling roller 13 of the feeding device according to the invention performs with the utmost reliability its function of preventing the issuing from the hopper of deformed filter plugs or of clusters of filter plugs that may disturb the regular operation of the downstream devices or machines.

Figure 4:
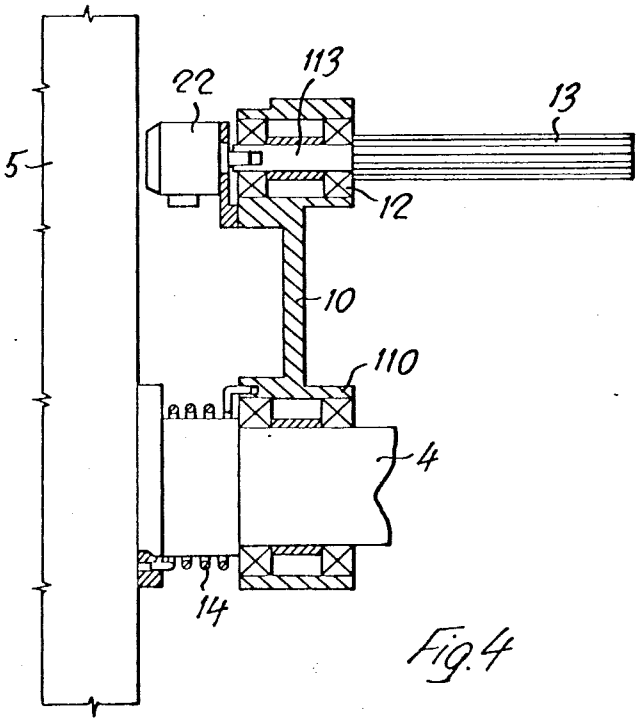
FIG. 4 is a part-sectional view similar to that of FIG. 2, showing another embodiment of the means for changing the speed of rotation of the repelling roller.

In FIG. 4 there is shown a modified embodiment of the means for driving in rotation the repelling roller 13. In this case, the repelling roller 13 is driven by a small, preferably D.C. electric motor which is mounted onto the swingable lever 10 and is connected through shaft 113 to the said roller 13.

It is not always required to reduce the speed of rotation of the repelling roller 13 during its travel from its normal operative position, for obtaining the advantages as afforded by the other features of the invention. Anyway, such a reduction of the speed of rotation of the repelling roller 13 can be obtained also in the case of the modified embodiment according to FIG. 4, by correspondingly changing the input to the electric motor 22, for example, by means of a rheostat or a commutator actuated by the swingable lever 10, or in any other equivalent manner.

I claim:

1. A feeding device for withdrawing rod-like articles, particularly filter plugs (B) in the manufacture of filter-tipped cigarettes, from a feeding hopper (1), and for singling the articles, the hopper having a bottom defining an outlet passage for the articles, said device comprising: a hopper wall (9) adjacent the outlet passage; a rotary drum (2) having a peripherl surface provided with flutes (102), said drum forming at least part of the bottom of the hopper (1) and extending out of the hopper bottom; a repelling roller (13) having a central axis, said roller (13) being rotatable about said central axis and being disposed between said hopper wall (9) and said drum (2) in the region where said drum (2) extends out of the hopper bottom; means for rotating said roller (13) about said central axis in the same angular direction as said drum (2) so as to push back the rod-like articles which are not contained in the flutes (102) and to prevent those rod-like articles from leaving the hopper or from becoming wedged between said hopper wall (9) and said drum (2); means supporting said roller (13) in a compliant manner and applying to said roller (13) a return force for urging said roller (13) toward a normal operative position, said roller (13)

being displaceable against the return force toward a displaced position upon engagement of said roller (13) by one or more abnormal rod-like articles engaged in, and excessively protruding from, a said flute (102); and sensor means responsive to movement of said roller (13) to said displaced position for providing an indication of a fault condition; wherein said means supporting said roller (13) comprise a mechanism for causing the displacement of said roller (13) between the normal operative position and the displaced position to be constituted by movement of the central axis of said roller (13) along a path parallel to said peripheral surface of said drum (2) and in the direction of the circumference of said drum.

2. The device according to claim 1, characterized in that said mechanism comprises, a roller-carrying lever (10) which is swingable about a shaft (4) being concentric or close to the shaft for the rotation of drum (2).

3. The device for according to claim 2, characterized in that at least part of the hopper wall (9) situated at the location from which the drum (2) comes out of the hopper (1) is movable with the repelling roller (13).

4. The device according to claim 1, characterized in that the speed of rotation of the repelling roller (13) is automatically reduced during its travel from its normal operative position toward its displaced position, and is increased during the reverse travel of the repelling roller (13), and regains its predetermined value when the repelling roller (13) has again reached its normal operative position.

5. The device according to claim 4, characterized in that said means for rotating said roller (13) comprise a driving pinion (16) in mesh with a driving endless belt (17) with a dual set of teeth and extending substantially parallel to the path of movement of the central axis of said repelling roller (13).

6. The device according to claim 1, characterized in that said means for rotating said roller (13) comprise an electric motor (22).

7. The feeding device according to claim 1, characterized in that said sensor means are operative for generating a warning signal when the repelling roller does not reach its displaced position and is returned to its normal operative position without promoting the stopping of the drum or of the associated machine.

8. The device according to claim 3 characterized in that said at least part of the hopper wall is attached to said roller-carrying lever.

* * * * *